United States Patent [19]

Hartmannsgruber et al.

[11] 4,314,388

[45] Feb. 9, 1982

[54] ROLLER DRIVE FOR DRAW FRAME

[75] Inventors: Max Hartmannsgruber, Kirchheim; Horst Wolf, Albershausen, both of Fed. Rep. of Germany

[73] Assignee: Zinser Textilmaschinen GmbH, Ebersbach, Fed. Rep. of Germany

[21] Appl. No.: 132,809

[22] Filed: Mar. 24, 1980

[30] Foreign Application Priority Data

Mar. 23, 1979 [DE] Fed. Rep. of Germany ..... 2911379

[51] Int. Cl.[3] ..... D01H 1/22

[52] U.S. Cl. ..... 19/293; 57/92; 57/100; 74/665 G

[58] Field of Search ..... 19/293, 294, 295; 74/665 G, 665 N; 57/92, 100

[56] References Cited

U.S. PATENT DOCUMENTS

| | | | |
|---|---|---|---|
| 2,875,645 | 3/1959 | Keyser | 74/665 N |
| 4,161,862 | 7/1979 | Hartmannsgruber et al. | 19/293 X |
| 4,195,389 | 4/1980 | Schulz et al. | 74/665 G |

OTHER PUBLICATIONS

"Textile Applications of Adjustable-Frequency Drives with Digital Ratio Control", by Edward H. Dinger, IEEE Transaction of Industry Applications, vol. IA-8, Jan.-Feb. 1972.

*Primary Examiner*—Louis Rimrodt
*Attorney, Agent, or Firm*—Karl F. Ross

[57] ABSTRACT

An assembly of fiber-drawing rollers, used for stretching rovings or fiber bundles in a spinning machine, is divided into a plurality of stages each including an elongate driven roller and a set of coacting counterrollers, the driven rollers being rotated at predetermined relative speeds with the aid of several motors including at least one pair of synchronous motors positively coupled with a drawing roller at opposite ends thereof. These synchronous motors are energized with three-phase current of a frequency determined by the setting of a digitally adjustable frequency selector controlling a solid-state frequency inverter. The selector comprises a frequency divider in the output of a preferably also adjustable source of timing signals which may be a pulse generator driven by a motor coupled with another drawing roller.

9 Claims, 3 Drawing Figures

ROLLER DRIVE FOR DRAW FRAME

FIELD OF THE INVENTION

Our present invention relates to a fiber-drawing assembly as used for the stretching of rovings or fiber bundles in a spinning machine.

BACKGROUND OF THE INVENTION

In commonly owned U.S. patent application Ser. No. 907,413 filed May 18, 1978 by Günter Schulz and Konrad Klein, now U.S. Pat. No. 4,195,389, granted Apr. 1, 1980, there has been disclosed an assembly of this type comprising a plurality of cascaded drawing stages each including an elongate driven roller and a set of coacting, nondriven counterrollers. The driven rollers of these stages are rotated simultaneously at different speeds, progressively increasing from the first stage to the last, by duplicate gear trains connected to opposite ends of each driven roller in order to apply substantially identical torques to these ends for minimizing torsional stresses. It is also known to couple two coaxial roller sections to each other via a common spur gear; see U.S. Pat. No. 2,875,645.

The use of gears for the equalization of torques is inconvenient in cases where the speed ratio between the various drawing stages must be frequently changed. Such a change necessitates the replacement of certain gears which can be done only at standstill and which, moreover, may lead to errors with serious consequences as pointed out in the commonly owned patent referred to. Thus, the system described in that patent includes special torque-limiting means designed to obviate the effects of such errors of reassembly.

It has also been proposed heretofore to supplement the action of a main drive motor, coupled with a drawing roller at one end thereof, by means of an ancillary motor of lesser power driving the opposite end of that roller. This expedient, however, can only reduce but does not eliminate the torsional stresses occurring in a long roller driven only at one end.

OBJECT OF THE INVENTION

The object of our present invention is to provide a simple solution to the problem of torsional stresses in long drawing rollers which does not require any torque-limiting means and greatly facilitates a change in the speed ratios of the several drawing stages.

SUMMARY OF THE INVENTION

In accordance with our present invention we provide, as part of the drive means for simultaneously rotating the driven rollers of a plurality of drawing stages at different but mutually correlated speeds, at least one pair of synchronous motors positively coupled with one such driven roller at axially spaced-apart locations, preferably at its ends, these motors being energized in step with each other by a common supply of three-phase current.

Advantageously, pursuant to a more particular feature of our invention, the current supply comprises a solid-state frequency inverter with three phase leads inserted between a power line and the two synchronous motors as well as a frequency selector connected to the inverter for varying the rhythm of energization of its phase leads. The inverter may be of the digitally adjustable type described in an article entitled "TEXTILE APPLICATIONS OF ADJUSTABLE-FREQUENCY DRIVES WITH DIGITAL RATIO CONTROL" by Edward H. Dinger, IEEE Transactions on Industry Applications, Vol. IA–8, No. 1, January/February 1972, pages 47–55.

In a draw frame with rollers driven only at one end, whose stages include an input stage, one or more intermediate stages and an output stage, the torsional stresses encountered especially during start-up and run-down of the machine are particularly critical in the intermediate stage or stages whose rollers primarily determine the tension imparted to the rovings. At least one intermediate roller, therefore, should be driven by two or possibly more synchronous coaxial motors operating in unison. If two or more driven rollers have drive motors positively coupled thereto, one such motor may serve as a master by also operating a pulse generator feeding the frequency selector or selectors associated with the drive motors of the other stage or stages. Such an arrangement is also disclosed in our copending application Ser. No. 132,770 filed concurrently herewith.

Our invention allows the use of drawing rollers about 30 to 40 meters in length, compared with about half that length with conventionally end-driven rollers, in a drawing frame feeding a textile machine of the ring-spinning or flyer-spinning type. Even greater lengths are possible if a roller is driven by more than two coaxial motors in synchronism with one another.

BRIEF DESCRIPTION OF THE DRAWING

The above and other features of our present invention will now be described in detail with reference to the accompanying drawing in which.

SPECIFIC DESCRIPTION

Figure 1:
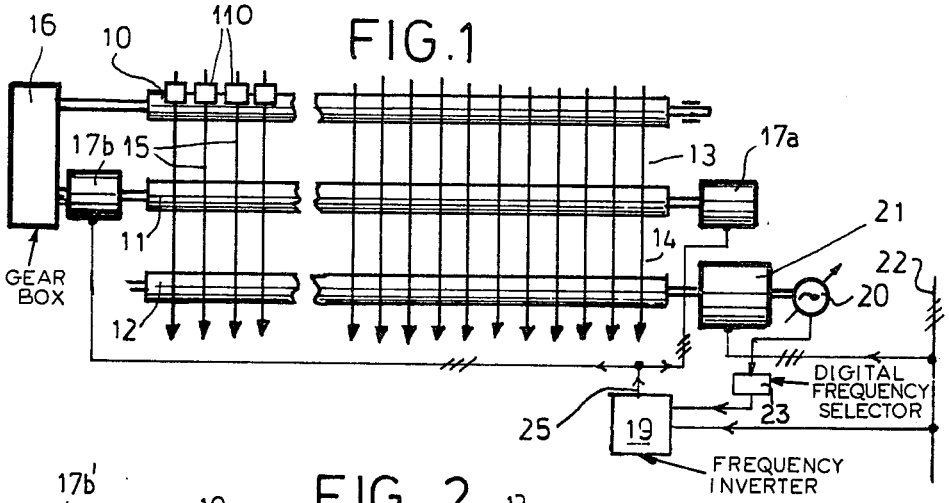
FIG. 1 is a diagrammatic plan view of a three-stage drawing frame provided with drive motors according to our invention.

In FIG. 1 we have shown, as part of a ring or flyer spinning machine not further illustrated, a draw frame with three elongate driven rollers 10, 11 and 12 forming part of an input stage, an intermediate stage and an output stage, respectively. These rollers coact with respective sets of nondriven counterrollers, some of which have been illustrated at 110 for the input-stage roller 10. Arrows 15 schematically indicate filamentary material such as rovings passing between these stages with progressively increasing stretch. The fibers are pretensioned in a zone 13 between rollers 10 and 11 and are further tensioned in a main working zone 14 between rollers 11 and 12. The number of counterrollers per stage, and thus of rovings fed to respective wind-up stations of the spinning machine, may range between 200 and 500.

Intermediate roller 11, in which the development of torsional stresses is particularly undesirable as explained above, is driven by two synchronous motors **17*a* and 17*b* positively coupled thereto at opposite ends. These motors have a joint operating circuit 25 energized from a power supply 22, schematically illustrated as a three-phase network, via a solid-state frequency inverter 19 under the control of a digital frequency selector 23 to which timing signals are supplied by a pulse generator 20. The latter is driven by a master motor 21 which also rotates the output-stage roller 12 and, though preferably likewise of the synchronous type, could also be an induction motor. The pulses produced by generator 20** could further be used to control the operating speed of other components of the textile machine, e.g. its spindles, as described in our concurrently filed application identified above.

Since in many instances the fiber bundles 15 undergo only limited stretching in the pretensioning zone 13, e.g. with an elongation ranging from 1.02 to 4, possible torque differences at opposite ends of input-stage roller 10 may not be of major significance so that this roller could be driven from just one end, as shown. Also, the speed ratio between rollers 10 and 11 may not require much changing wherefore a mechanical coupling in the form of a gear box 16 between roller 10 and drive motor 17*b* may be suitable. By the same token, the output-stage roller 12 may also be satisfactorily driven from one end only, i.e. by motor 21.

Figure 2:
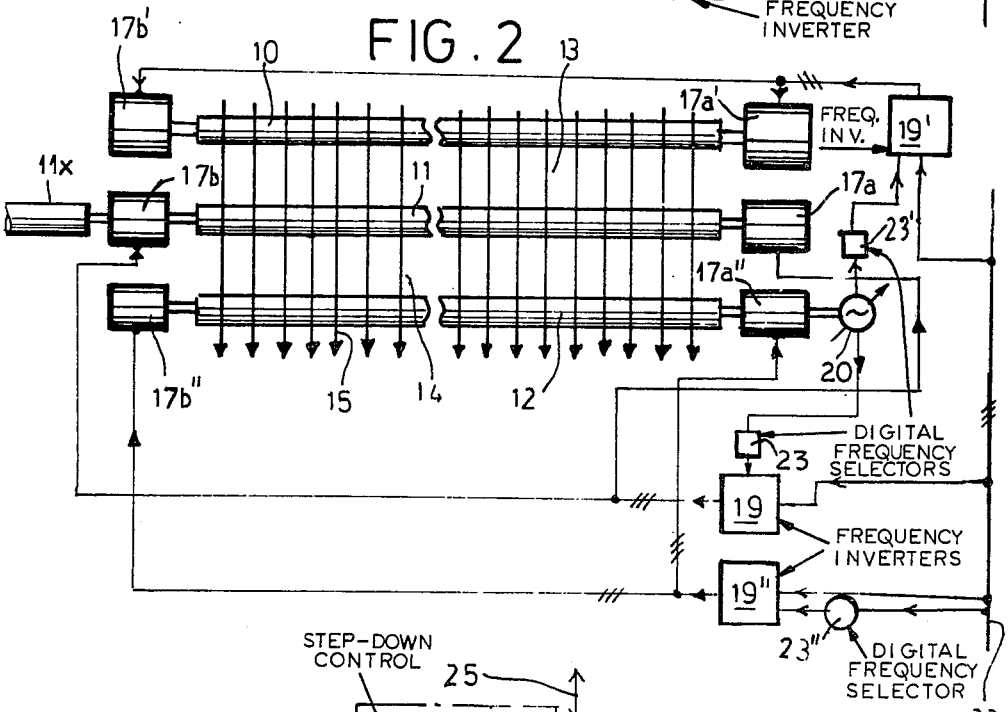
FIG. 2 is a view similar to FIG. 1, illustrating a modified drive-motor assembly.

As illustrated in FIG. 2, however, we may provide respective pairs of synchronous motors 17*a*', 17*b*' and 17*a*'', 17*b*'' for rollers 10 and 12 coaxial therewith. A second frequency selector 23' digitally controls, in response to pulses from generator 20 driven by motor 17*a*'', a solid-state frequency inverter 19' determining the operating speed of motors 17*a*', 17*b*' and thus of roller 10. The speed of motor 17*a*'' is here determined, jointly with that of its mate 17*b*'', by an additional solid-state inverter 19'' manually settable by a digital frequency selector 23'' connected to power line 22.

The draw frame including rollers 10–12 may be laterally extended with the aid of additional rollers coaxially juxtaposed therewith and driven at the same speed, as particularly illustrated for a roller 11*x* aligned with roller 11 and positively coupled with its drive motor 17*b*. A third synchronous motor, not shown, may be positively coupled to the remote end of roller 11*x* and may be energized in step with motors 17*a* and 17*b* by the output of frequency inverter 19. Obviously, as many roller sections as desired could be so interconnected in each drawing stage for joint rotation without significant torsional stresses.

Figure 3:
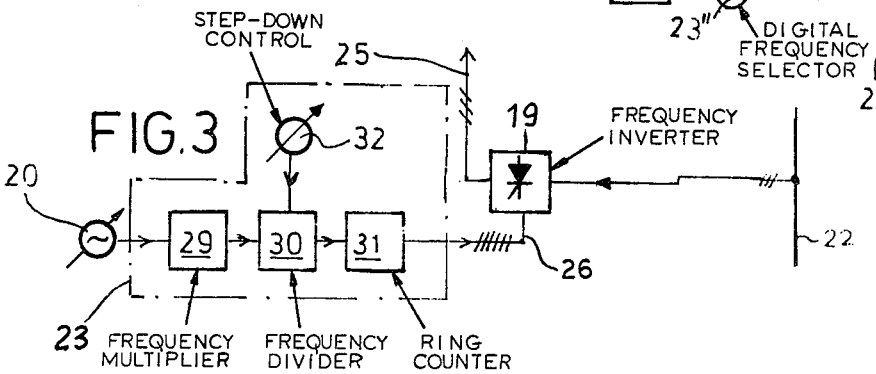
FIG. 3 is a block diagram of a digitally settable frequency selector used in the systems of FIGS. 1 and 2.

The frequency inverters 23, 23', 23'' may be of the solid-state type described in the above-identified article by Edward H. Dinger, including a d-c link with positive and negative conductors which are sequentially connectable to the outgoing phase leads with the aid of three pairs of electronic switches, particularly thyristors, in a rhythm determined by the cadence of gating pulses obtained from the associated selector. The representative frequency selector 23 illustrated in FIG. 3 comprises a frequency multiplier 29 receiving the output of pulse generator 20 and working into a frequency divider 30 whose step-down ratio is adjustable by a digital control device 32 such as a thumbwheel as also described in the Dinger article. Multiplier 29 may have a step-up rate of 1000:1, for example, while divider 30 may have a step-down ratio variable in unity increments between 100:1 and 10,000:1 for very fine speed control. Such a divider may comprise a pulse counter resetting itself upon reaching the maximum count chosen by control device 32, each return to zero being accompanied by the emission of one pulse to a ring counter 31 which distributes these pulses to the gates of the three pairs of thyristors included in the associated frequency inverter 19 as schematically indicated in FIG. 3. Ring counter 31 may have six stages with respective output leads forming part of a multiple 26. Since the inverters 19, 19', 19'' all operate on direct current, power line 22 need not be a three-phase network as shown.

We claim:

1. A fiber-drawing assembly comprising:

a plurality of cascaded drawing stages each including an elongate driven roller and a set of coacting counterrollers;

drive means for simultaneously rotating said driven rollers at different but mutually correlated speeds, said drive means including at least one pair of synchronous motors positively coupled with opposite ends of the driven roller of one of said drawing stages at axially spaced-apart locations; and a common supply of three-phase current connected to said pair of synchronous motors in a joint energizing circuit for operating same in step with each other, thereby preventing the development of torsional stresses between said locations, said supply including a power line, a solid-state frequency inverter with three phase leads inserted between said power line and said pair of synchronous motors, and a frequency divider of digitally variable step-down ratio inserted between a source of timing signals and said frequency inverter for varying the rhythm of energization of said phase leads.

2. An assembly as defined in claim 1 wherein said frequency selector further comprises a frequency multiplier inserted between said source and said frequency divider.

3. An assembly as defined in claim 1 wherein said drive means includes a further motor coupled with the driven roller of another of said drawing stages, said source comprising a pulse generator driven by said further motor.

4. An assembly as defined in claim 3 wherein said further motor is one of a second pair of synchronous motors energized in step with each other by said power line and positively coupled with the driven roller of said other of said drawing stages at axially spaced-apart locations.

5. An assembly as defined in claim 4, comprising a second frequency inverter with three phase leads inserted between said power line and said second pair of synchronous motors, and a second frequency selector connected to said second frequency inverter for varying the rhythm of energization of the phase leads of said second frequency inverter.

6. An assembly as defined in claim 3, 4 or 5 wherein said drawing stages include an input stage, an intermediate stage and an output stage, said one of said drawing stages being said intermediate stage.

7. An assembly as defined in claim 6 wherein said other of said drawing stages is said output stage.

8. An assembly as defined in claim 7 wherein said drive means includes an additional pair of synchronous motors energized in step with each other by said power line and positively coupled at axially spaced-apart locations with the driven roller of said input stage.

9. An assembly as defined in claim 8, comprising an additional frequency inverter with three phase leads inserted between said power line and said additional pair of synchronous motors, and an additional frequency selector connected to said additional frequency inverter for varying the rhythm of energization of the phase leads of said additional frequency inverter, said additional frequency selector comprising another frequency divider of digitally variable step-down ratio inserted between said pulse generator and said additional frequency inverter.

* * * * *